US005979561A

United States Patent [19]

Edwards et al.

[11] Patent Number: 5,979,561

[45] Date of Patent: Nov. 9, 1999

[54] DOWNHOLE ACTIVATION CIRCUIT VALVING

[75] Inventors: A. Glen Edwards, Hockley; Klaus B. Huber, Sugarland, both of Tex.

[73] Assignee: Schlumberger Technology Corporation, Sugar Land, Tex.

[21] Appl. No.: 08/760,391

[22] Filed: Dec. 4, 1996

[51] Int. Cl.[6] ..... E21B 33/12

[52] U.S. Cl. ..... 166/386; 166/317

[58] Field of Search ..... 166/317, 386

[56] References Cited

U.S. PATENT DOCUMENTS

| | | | |
|---|---|---|---|
| 2,674,313 | 4/1954 | Chambers . | |
| 3,208,355 | 9/1965 | Baker et al. . | |
| 3,209,937 | 10/1965 | Hirst et al. . | |
| 3,589,442 | 6/1971 | Kilgore . | |
| 4,515,217 | 5/1985 | Stout . | |
| 4,557,331 | 12/1985 | Stout . | |
| 4,597,439 | 7/1986 | Meek | 166/163 |
| 4,603,741 | 8/1986 | Edgmon . | |
| 4,616,701 | 10/1986 | Stout et al. . | |
| 4,817,718 | 4/1989 | Nelson et al. . | |
| 5,287,924 | 2/1994 | Burleson et al. . | |
| 5,293,940 | 3/1994 | Hromas et al. . | |
| 5,318,126 | 6/1994 | Edwards et al. . | |
| 5,355,957 | 10/1994 | Burleson et al. . | |
| 5,366,013 | 11/1994 | Edwards et al. . | |
| 5,429,192 | 7/1995 | Huber et al. . | |
| 5,462,117 | 10/1995 | Green et al. . | |
| 5,509,481 | 4/1996 | Huber et al. . | |
| 5,509,482 | 4/1996 | Dillon et al. . | |

FOREIGN PATENT DOCUMENTS

| | | |
|---|---|---|
| 0 647 766 A2 | 4/1995 | European Pat. Off. . |
| 2 291 168 | 1/1996 | United Kingdom . |

OTHER PUBLICATIONS

Snider, Philip M., "Selectively fired, tubing–conveyed perforating guns save rig time", Oil & Gas Journal Jul. 19, 1993.

*Primary Examiner*—Hoang C. Dang
*Attorney, Agent, or Firm*—Jeffrey E. Griffin; Gordon G. Waggett; John R. Ryberg

[57] ABSTRACT

A downhole valve for use within a string of tools in a well for controlling a hydraulic activation circuit. The valve has a housing with an inlet and an outlet, defining a portion of the circuit extending between the inlet and the outlet. A moveable piston within the housing in a first position provides communication between uphole and downhole parts of the circuit, and in a second position isolates the uphole and downhole parts of the circuit. A frangible member is constructed to support, in an intact condition, the piston in one of these two positions against a biasing force, and in a shattered condition enables the piston to move in response to the biasing force to the other position. A detonating member extending through the frangible member propagates a detonation wave to shatter the frangible member when desired, closing the valve. The valve is capable of closing very rapidly, and is particularly useful for isolating an uphole part of a hydraulic activation circuit when used with detonatable tools that can damage hydraulic control lines upon detonation, such as perforating guns. In other embodiments the valve is used to enable hydraulic activation of a tool when opened by a detonation. Methods of altering a hydraulic activation circuit within a string of tools in a well are also disclosed.

5 Claims, 3 Drawing Sheets

DOWNHOLE ACTIVATION CIRCUIT VALVING

BACKGROUND OF THE INVENTION

In completing a product recovery well, such as in the oil and gas industry, several downhole tasks or functions must generally be performed with tools lowered through the well pipe or casing. These tools include, depending on the required tasks to be performed, perforating guns that ballistically produce holes in the well pipe wall to enable access to a target formation, setting tools that install well-sealing bridge plugs at a desired depth within the pipe, packer-setting tools that create a temporary seal about the tool and valves that are opened or closed.

Several tools can be configured as a single tool string lowered on the end of a long, hollow tube filled with fluid, the tools being hydraulically activatable in sequence by pressurizing either the fluid in the tube or the interior of the well casing. Such a configuration of tools has included perforating guns carefully arranged to perforate the well casing without damaging the internal hydraulic activation circuit of the string.

Within these tool strings, explosive-based firing heads are frequently employed to trigger the detonation of associated downhole perforating guns or other tools. Due to safety issues understood by those familiar with well completion techniques, the detonation of a gun by a firing head is typically accomplished by a series of linked detonations that effectively transfer a detonation from the firing head to the gun across separable joints in the tool string in an assembly that enables the armed firing head to be assembled to the gun at the last possible moment. The firing head is generally separated from the gun by a spacer of sufficient length that when the firing head is finally assembled to the tool string by workers on a rig platform, the associated gun, already lowered into the well casing, is safely below the platform. A detonating cord, sometimes called primacord, typically extends down an internal bore of the spacer between the firing head and its associated gun to link the firing head to the gun.

SUMMARY OF THE INVENTION

The present invention relates to an apparatus for explosively activating a hydraulic valve of a string of tools in a well bore to alter an internal hydraulic activation circuit. Embodiments of the invention enable multiple tools in the string to share a hydraulic activation circuit, and enable isolation of a part of the circuit damaged by an explosion associated with activation of a tool, so that remaining tools may be effectively operated by the common hydraulic circuit.

According to one aspect of the invention, a downhole valve for use within a string of tools in a well for controlling a hydraulic activation circuit has a housing with an inlet and an outlet, the housing defining a portion of the circuit extending between the inlet and the outlet. A moveable piston within the housing, which in a first position provides communication between the inlet and the outlet and in a second position isolates the inlet from the outlet, is constructed to be biased in use by a biasing force toward one of the first and second positions. The valve also has a frangible member that in an intact condition is constructed to support the piston in the other of the first and second positions against the biasing force, and in a shattered condition enables the piston to move in response to the biasing force to the one of the first and second positions. A detonating member is arranged to propagate a detonation wave to shatter the frangible member when desired.

In one embodiment, the piston is constructed to be biased toward a closed position to isolate an uphole part of the circuit from a downhole part of the circuit when the frangible member is shattered.

In another embodiment, the piston is constructed to be biased toward an open position to enable the subsequent activation of a lower hydraulically activatable tool when the frangible member is shattered.

In a preferred configuration, the housing defines a port between the piston and an adjacent region of the well to enable well pressure in the region to bias the piston toward the one of the first and second positions. In a particularly advantageous embodiment, the piston is constructed to move to the one of the first and second positions in less than about 10 milliseconds after the propagation of the detonation wave has commenced, when the well pressure exceeds about 2000 psi.

In another aspect of the invention, a section of a string of tools for performing a downhole function in a well comprises a detonatable tool that includes a lower part of a hydraulic activation circuit which is exposed to be damaged by the detonation of the tool. A shutoff valve located above the tool is constructed to close to isolate an upper part of the activation circuit from the lower part of the circuit in response to a detonation wave associated with the detonation of the tool.

In the presently preferred configuration the shutoff valve comprises a housing and a moveable piston within the housing. In a first position the piston enables hydraulic communication between the upper and lower parts of the circuit and in a second position isolates the upper part from the lower part. The piston is constructed to be biased in use toward the second position.

In another embodiment the valve includes a frangible member that in an intact condition is constructed to support the piston in the first position, and in a shattered condition enables the piston to move to the second position. A detonating member is arranged to propagate a detonation wave to detonate the tool, and the frangible member arranged to be shattered upon propagation of the wave to close the valve.

In some instances the section also comprises a firing head above the shutoff valve for explosively triggering the tool by detonating the detonating member. The detonating member, in the current configuration, is in the form of an elongated cord extending through the frangible member.

In another embodiment the tool comprises a tool housing, an array of perforating charges to be detonated for perforating the well, and a hydraulic line which is exposed to be damaged by the detonation of the charges and enables hydraulic communication with another lower section. In some cases the line is disposed within the tool housing. In other cases the line is external to the tool housing and at least one of the charges is aligned substantially with the hydraulic line such that the line is exposed to be damaged by the detonation of at least one charge.

In another aspect of the invention, a string of tools for performing downhole functions in a well comprises upper, middle and lower sections connected in parallel hydraulic communication to an activating circuit and arranged to be activated in a bottom-up order. The upper and lower sections each have a hydraulically activatable device, and the middle section has a detonatable tool with a through-passing hydraulic line, exposed to be damaged by the detonation of the tool, for activating the hydraulically activatable device of the lower section. A shutoff valve is located above the tool, constructed to close to isolate an upper part of the activation circuit from a lower part of the circuit in response to a detonation wave associated with the detonation of the tool to enable the subsequent hydraulic activation of the upper section.

In some preferred embodiments the shutoff valve comprises a housing, a moveable piston within the housing which in a first position exposes a first port to enable hydraulic communication between the upper and lower parts of the circuit and in a second position blocks the first port to isolate the upper part from the lower part, and a second port defined by the housing between the piston and an adjacent region of the well to enable well pressure in the region to bias the piston toward the second position. A frangible member is provided that in an intact condition is constructed to support the piston in the first position, and in a shattered condition enables the piston to move to the second position. A detonating member is arranged to propagate a detonation wave to detonate the tool, and the frangible member arranged to be shattered upon propagation of the wave to close the valve.

In some cases, the tool of the middle section further has a tool housing, with the through-passing hydraulic line is disposed within the tool housing.

In a particularly useful embodiment, the tool of the middle section further has a tool housing and an array of perforating charges to be detonated for perforating the well. The through-passing hydraulic line is external to the tool housing, and at least one of the charges is aligned substantially with the hydraulic line such that the line is exposed to be damaged by the detonation of the charge.

In another aspect of the invention, a method is provided for controlling a hydraulic activation circuit within a string of tools in a well. The method comprises providing a valve, containing a piston and a frangible element, disposed between the uphole and downhole parts. The piston is arranged to move under well pressure forces from a first position to a second position to desirably alter the hydraulic circuit, and is supported in the first position by the frangible element. The method also comprises exposing the piston to well pressure forces, and shattering the frangible element to enable the piston to move to the second position to alter the circuit when desired.

In some embodiments the well pressure forces bias the piston toward a closed position to isolate an uphole part of the circuit from a downhole part of the circuit upon the shattering of the frangible element.

In a particularly useful embodiment, the piston is exposed to well pressure of at least 2000 psi, and effectively alters the circuit in less than about 10 milliseconds after the frangible element is shattered.

In some particularly advantageous embodiments, the present invention maintains the integrity of the internal activating hydraulic system of a tubing-conveyed string of detonatable tools during sequential detonation of the tools, advantageously enabling the sequential firing of perforating guns or other tools having internal hydraulic lines that tend to be damaged when the tools are operated. In this manner, a string containing middle-positioned guns may be lowered into the well and operated in a bottom-up sequence, as particularly advantageous in certain conditions, one at a time when desired.

In other embodiments, the valve of the invention controllably alters a hydraulic activation circuit within a string of tools in a well by opening in response to a detonation wave passing through the frangible member, thereby enabling the subsequent hydraulic activation of a tool in the string.

Figure 3:
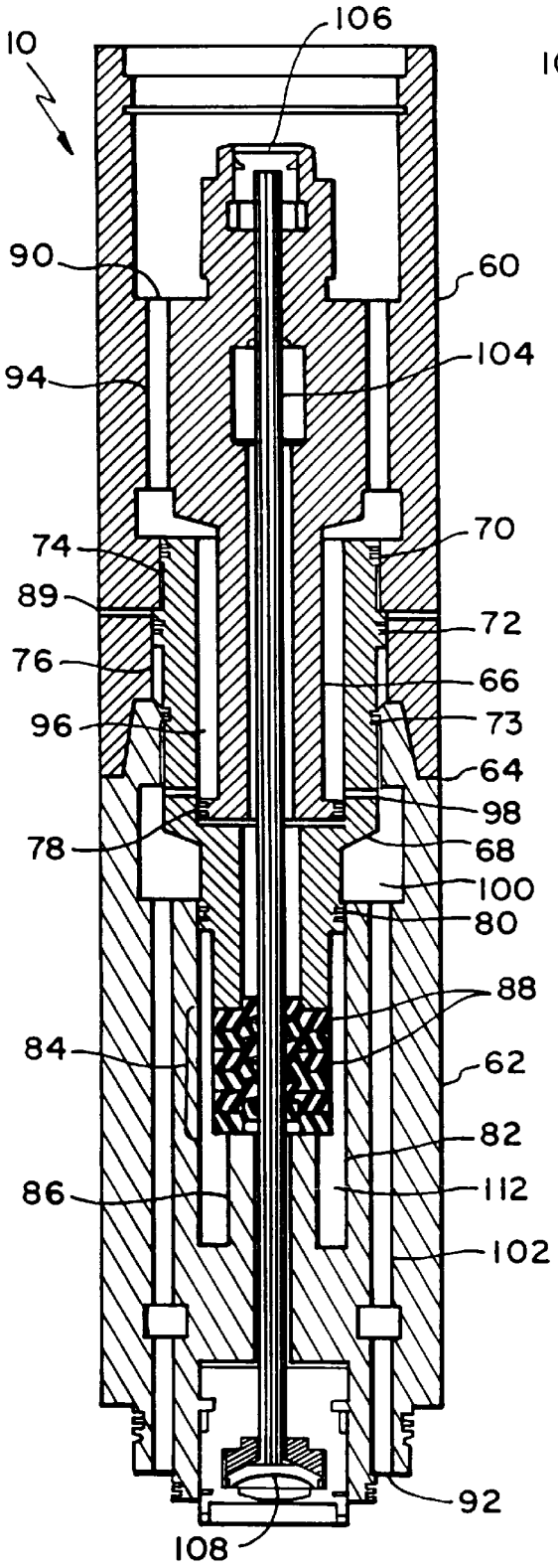
Figure 4:
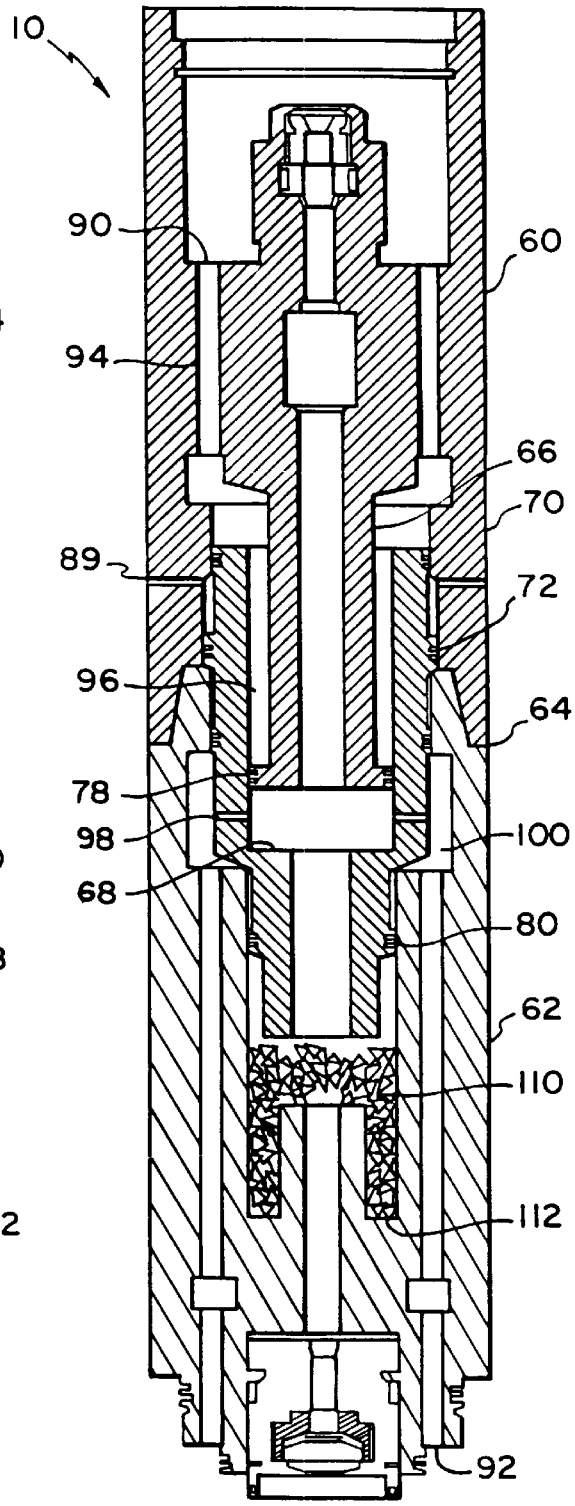
Figure 5:
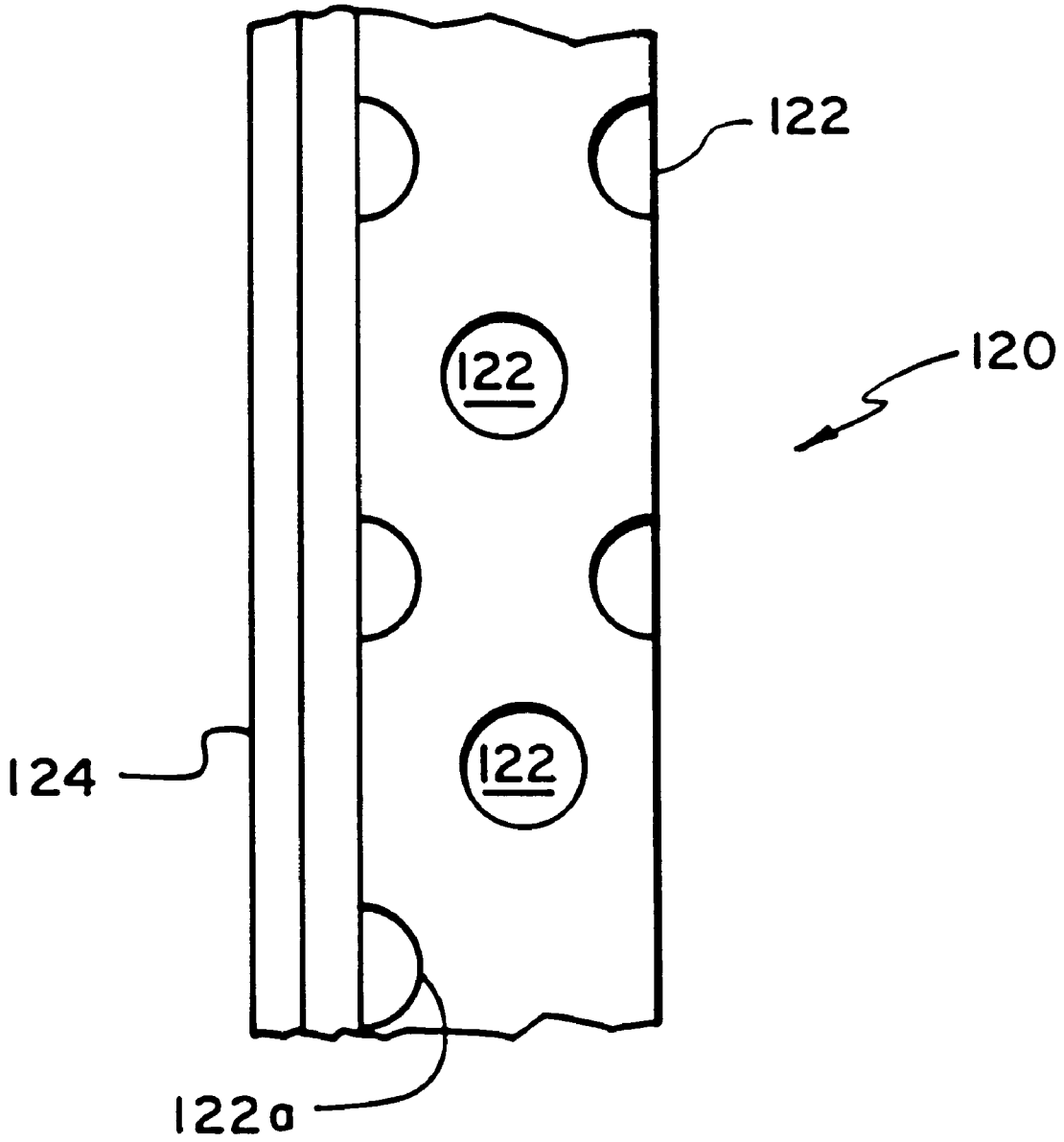

FIG, 3 is a cross-section of a presently preferred embodiment of the shutoff valve in an open condition;

FIG. 4 is a cross-section of the shutoff valve of FIG. 3 in a closed condition; and FIG. 5 illustrates a perforating gun with an array of charges and an external hydraulic line.

DESCRIPTION OF THE PREFERRED EMBODIMENT

Figure 1:
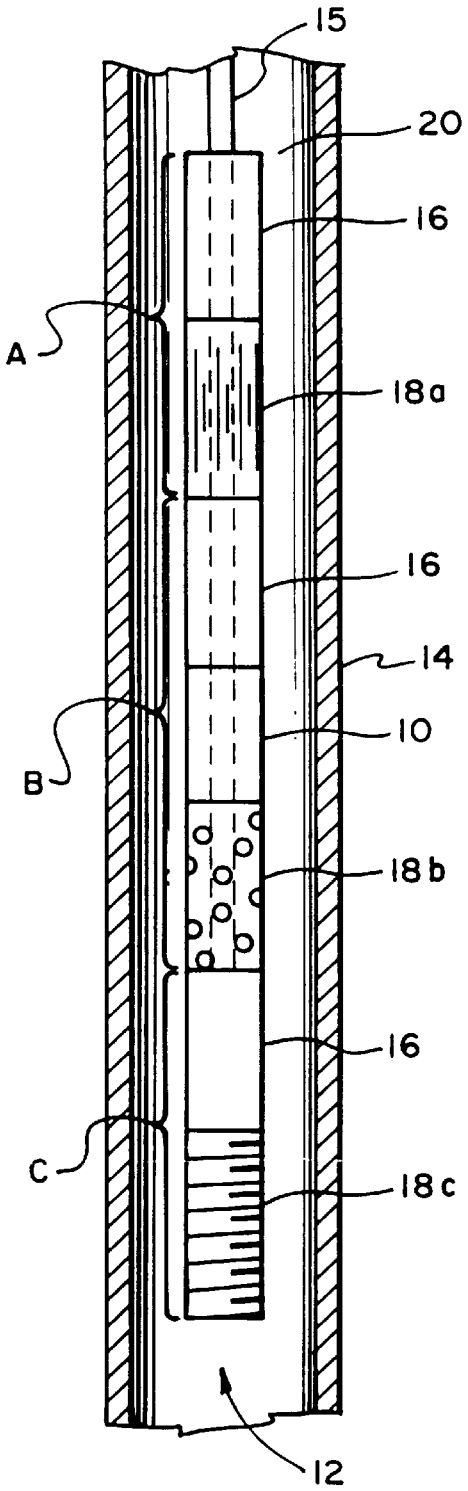
FIG. 1 illustrates a downhole tool string containing a valve according to the invention.

Referring to FIG. 1, a shutoff valve 10 according to a preferred embodiment of the invention is part of a string 12 of tools which is lowered into a well casing 14 on a length of tubing 15 to perform desired downhole functions, typically related to well completion. In this particular embodiment, string 12 consists of an upper functional section A, a middle functional section B, and a lower functional section C, each containing a hydraulically-activated firing head 16 that detonates an associated tool (18*a* in Section A, 18*b* in Section B, and 18*c* in Section C) to perform a respective function.

The firing head 16 of each section is activated by a respectively selected elevated hydraulic pressure condition, preferably pressure conditions transmitted from the well surface through tubing 15, such as selected hydraulic pressures and/or selected durations of application of the pressures. An internal hydraulic path provided by internal ports and lines (not shown) transmits this activating pressure through upper sections A and B, such that in an initial state all three firing heads 16 are connected in parallel hydraulic communication to tubing 15. To enable the pressure inside tubing 15 to be elevated to activate firing heads 16, the internal hydraulic passages of sections A and B that allow hydraulic activation of section C must be sealed from casing annulus 20, such that substantially no flow occurs within tubing 15 during the activation process. In various embodiments, tools 18*a*, 18*b* and 18*c* include perforating guns, bridge plug-setting tools, and other downhole equipment, although the invention has particularly useful application if middle tool 18*b* is a tool that has the potential to destroy the integrity of the internal hydraulic activation system by opening an undesirable hydraulic path from tubing 15 to well casing annulus 20 when the tool is operated, such as is typical with a perforating gun.

Shutoff valve 10 is constructed as a valve along the internal hydraulic communication passage from firing head 16 to tool 18*b* in middle section B. Valve 10 is initially in an open position, enabling the transmission of activating pressure to firing head 16 of lower section C, which is arranged to fire in sequence before section B. As described in detail below, shutoff valve 10 is arranged to close when the firing head 16 of middle section B detonates tool 18*b*, thereby avoiding the possibility of a breach in the hydraulic activation system caused by the operation of tool 18*b* damaging internal hydraulic lines. Once activated, valve 10 prevents the loss of hydraulic pressure within tubing 15 by isolating tubing 15 from all parts of the string lower than shutoff valve 10, thereby maintaining the operability of any firing heads 16 or other hydraulically operated downhole devices yet to be operated. In this manner, closing a shutoff valve 10 in a given functional section ensures the integrity of the hydraulic activation system for the operation of any functional sections arranged to fire later in sequence. Sections A and C are shown without shutoff valves 10 in the embodiment of FIG. 1 because tool 18*c* of the lowest section of a string is typically constructed without internal hydraulic lines, as there are no lower firing heads 16 to be hydraulically activated, and assuming that section A is the last section of the string to be operated, a breach in the hydraulic activation system occurring after it has been fired would be of little consequence. Other embodiments employ the shutoff valve of the invention in different arrangements, as required to maintain activating hydraulic circuit integrity.

Figure 2:
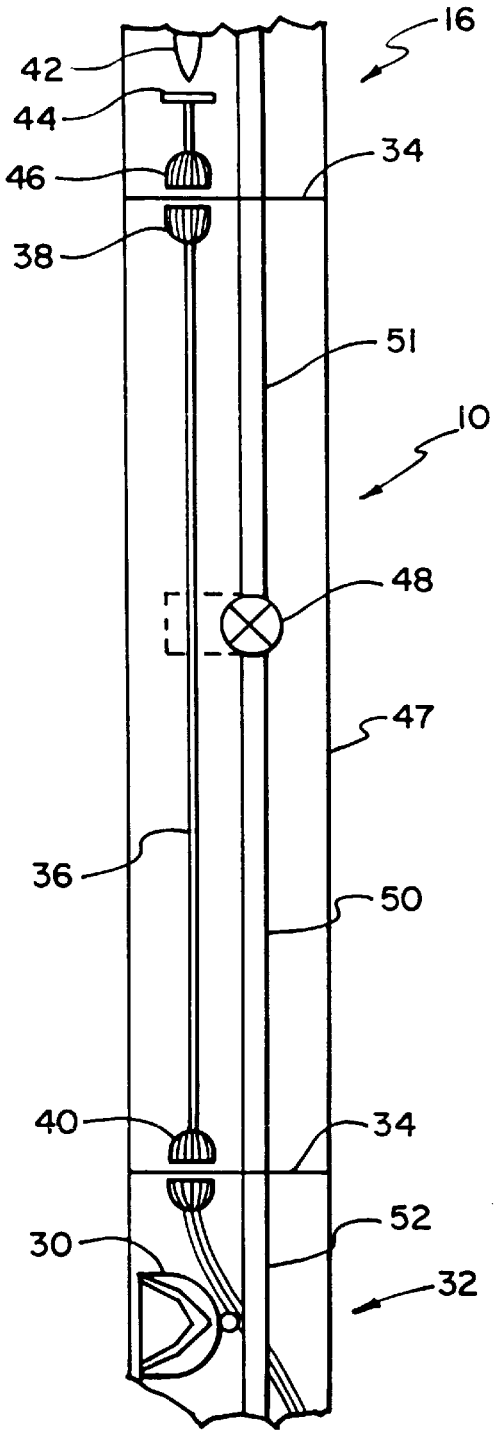
FIG. 2 schematically illustrates the function of a shutoff valve within a tool string section.

Referring to FIG. 2, firing head 16 in a particular arrangement of section B of FIG. 1 detonates charges 30 within perforating gun 32. Located between firing head 16 and gun 32, the housing 47 of shutoff valve 10 contains a length of detonator cord 36 (primacord) connecting an upper receptor booster 38 and a lower transfer charge 40. When firing head 16 is activated, a firing pin 42 impacts a detonator 44 that subsequently explodes a transfer charge 46. The explosion of transfer charge 46 detonates booster 38, which ignites detonator cord 36 As the detonation wave propagates downward through detonator cord 36 toward charge 40, it passes, and causes to permanently close, a valve element 48 along a hydraulic passage 50 within shutoff valve 10. Once valve element 48 closes, it blocks any subsequent transfer of internal hydraulic flow or pressure from firing head 16 to gun 32 or backflow of well annulus fluids into line 51. As shaped charges 30 of gun 32 are subsequently fired, therefore, any physical damage that might otherwise consequentially occur to the internal hydraulic passages 52 within gun 32 does not affect the internal activating hydraulic system above valve element 48.

Referring to FIG. 3, in the presently preferred embodiment shutoff valve 10 comprises an upper housing assembly 60 and a lower housing assembly 62, joined at threaded joint 64. Both housing assemblies include several separable portions, not shown, to enable efficient manufacturing and assembly. Upper housing assembly 60 includes a stem 66. Disposed about stem 66 is an operating piston 68 with o-ring seals 70 and 72 that seal against a small bore 74 and a large bore 76 of upper housing assembly 60, respectively, and o-ring seals 80 that seal against an inner bore 82 of lower housing assembly 62. 0-ring seals 78 about the lower end of stem 66 seal against an inner bore of the operating piston 68. In an open position, operating piston 68 is supported in an upper position, as shown, by a frangible member 84 between the piston and a support 86 of lower housing assembly 62. In the presently preferred configuration, frangible member 84 consists of a vertical stack of individual frangible elements 88 of gray-iron class 40 (spec number ASTM A48-76), otherwise more commonly known as grade 40 cast iron. The operating piston 68 is held downward against frangible member 84 by well pressure applied through ports 89 and acting on a differential area of the piston, the difference between areas bounded by the sealing diameters of o-ring seals 70 and 72. Because o-ring seal 72 has a larger sealing diameter than o-ring seal 70, the net force of pressure applied through ports 89 always tends to force piston 68 downward. All other hydraulic loads acting on piston 68 are balanced, due to equal pressures acting against equal areas of opposing o-ring seals, opposed ring pairs 80 and 78; 70 and 73.

With the operating piston 68 positioned as shown, hydraulic fluid is free to move through the length of the shutoff valve 10 between an inlet 90 and an outlet 92. The path of flow, from inlet to outlet, is as follows: down holes 94 in upper housing assembly 60, down annulus 96 about stem 66, outward through ports 98 in operating piston 68, down annulus 100, and down holes 102 in lower housing assembly 62. The hydraulic passages within the valve housings are of small size as there is very little hydraulic flow along this path even with the valve open, as the primary purpose of the hydraulic path in this embodiment is to transfer hydraulic pressure. In the open position shown, o-ring seals 78 at the lower end of stem 66 are below ports 98 in piston 68.

A detonating cord 104 (primacord) is disposed within a sealed bore that extends the length of the housings of shutoff valve 10, connecting a receptor booster 106 at the top of the shutoff valve with a trigger charge 108 at the bottom of the shutoff valve. Detonator cord 104 passes through the center of hollow frangible member 84. The primary function of detonator cord 104 is to transfer a detonation wave from receptor booster 106 to trigger charge 108, and in the process of transferring this detonation wave, detonator cord 104 is destroyed.

Referring also to FIG. 4, when the detonation wave propagating within detonator cord 104 passes through the center of frangible member 84, the individual frangible elements 88 will each shatter into a multitude of pieces due to the properties of the material (e.g. cast iron) of which they are made. When elements 88 shatter, the debris 110 from the frangible elements falls into annulus 112 of lower housing assembly 62, allowing operating piston 68 to move downward to a closed position (as shown) due to the force of well pressure applied through ports 89. The piston is in a closed position when ports 98 have been displaced a sufficient distance to be disposed below o-ring seals 78, with seals 78 thereby blocking any subsequent transfer of hydraulic pressure or flow between annulus 96 and ports 98.

Although cast iron is the presently preferred material of frangible elements 88, other materials may be employed. Suitable materials are selected and sized to be strong enough to support operating piston 68 in an unbroken condition, and brittle enough to shatter due to the propagation of the detonation wave down detonating cord 104. Certain ceramic materials, for instance, are suitable. In other embodiments, frangible member 86 is in the form of a single frangible plate member, or a supporting web. In other embodiments the frangible member is arranged to be loaded in tension rather than compression.

Piston 68 is constructed with a low inertia and a large differential pressure area, such that the piston is accelerated rapidly by biasing well pressure forces when the frangible member is shattered. Laboratory tests of prototypes have demonstrated that the piston moves fast enough to isolate the inlet and the outlet in less than about 10 milliseconds after the propagation of the detonation wave has commenced when the well pressure exceeds about 2000 psi.

The valve of the invention, configured to close in response to a detonation, is advantageously employed to enable the use of tool strings comprising several hydraulically activated firing heads that are arranged to be activated at different tubing pressures in a sequence from bottom up. This configuration is enabled by the function of the shutoff valve to reliably maintain the integrity of the activating hydraulic system, even when some hydraulic lines are damaged by the firing of nearby guns or other tools. The shutoff valve enables perforating guns of middle sections of a string of tools to be configured with internal hydraulic lines that tend to be destroyed by the firing of the gun, or with helical charge patterns that tend to damage even external lines but are useful for perforating some zones. For example, FIG. 5 illustrates an elongated gun 120 with an array of outwardly-facing perforating charges 122, some of which (e.g. charge 122*a*) are oriented to rupture a nearby external hydraulic line 124 upon detonation.

In a particularly useful configuration, the invention is employed in combination with the inventors' hydraulically activated firing head with hydro-mechanical locks, as described in U.S. patent application entitled "Device and Method for Performing Downhole Functions" filed Nov. 20, 1996, which is hereby incorporated by reference.

In other embodiments, the valve of the invention is configured to open in response to a detonation, employing a similar structure to that shown in FIG. 3 but arranged to open a port when a frangible member supporting a piston is shattered. In this case, the opening of the valve enables, in some instances, the subsequent operation of a hydraulically activatable tool. The valve may also be employed elsewhere in a string of downhole tools as a means for otherwise controlling a hydraulic activation circuit.

Other embodiments and advantages of the invention will occur to those skilled in the art. For example, more than three functional sections may be included in a string, with shutoff valves in each middle section, for performing four or more discrete functions in sequence with one trip down a well.

What is claimed is:

1. A downhole valve for use within a string of tools in a well for controlling a hydraulic activation circuit, the valve comprising:

a housing having an inlet and an outlet defining a portion of the circuit extending between the inlet and the outlet;

a moveable piston within the housing which in an open position provides communication between the inlet and the outlet and in a closed position isolates the inlet from the outlet, the piston constructed to be biased in use by a biasing force toward the closed position;

a frangible member that in an intact condition is constructed to support the piston in the open position against the biasing force, and in a shattered condition enables the piston to move in response to the biasing force to the closed position; and a detonating member arranged to propagate a detonation wave to shatter the frangible member when desired.

2. The valve of claim 1, wherein the housing defines a port between the piston and an adjacent region of the well to enable well pressure in the region to bias the piston toward the closed position.

3. The valve of claim 1, wherein the piston is constructed to move to the closed position in less than about 10 milliseconds after the propagation of the detonation wave has commenced when the well pressure exceeds about 2000 psi.

4. A method of controlling a hydraulic activation circuit having uphole and downhole ports within a string of tools in a well, comprising:

providing a valve disposed between the uphole and downhole ports of the hydraulic activation circuit, the valve including a piston and a frangible element, the piston being biased by well pressure forces toward a closed position to isolate an uphole part of the circuit from a downhole part of the circuit upon the shattering of the frangible element and being arranged to move under well pressure forces from an open position to the closed position, the piston being supported in the open position by the frangible element;

exposing the piston to well pressure; and shattering the frangible element to enable the piston to move to the closed position to alter the circuit.

5. The method of claim 4, wherein the piston is exposed to well pressure of at least 2000 psi, and moves to the closed position in less than about 10 milliseconds after the frangible element is shattered.

* * * * *